US010938185B1

(12) United States Patent
Matulich

(10) Patent No.: US 10,938,185 B1
(45) Date of Patent: Mar. 2, 2021

(54) SPARK PLUG ASSEMBLY FOR AN INTERNAL COMBUSTION ENGINE

(71) Applicant: Ford Global Technologies, LLC, Dearborn, MI (US)

(72) Inventor: Ryan Matulich, Farmington, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/015,434

(22) Filed: Sep. 9, 2020

(51) Int. Cl.
*H01T 13/08* (2006.01)
*H01T 13/20* (2006.01)
*H01T 13/32* (2006.01)
*H01T 13/12* (2006.01)

(52) U.S. Cl.
CPC ..... *H01T 13/32* (2013.01); *H01T 13/08* (2013.01); *H01T 13/12* (2013.01)

(58) Field of Classification Search
CPC ..... H01T 13/32; H01T 13/08; H01T 13/12
USPC ..... 313/143
See application file for complete search history.

(56) References Cited

U.S. PATENT DOCUMENTS 1,344,530 A * 6/1920 Zeigler ..... H01T 13/467 313/123
1,361,327 A * 12/1920 Hachmann ..... H01T 13/465 313/124
2,233,660 A 3/1941 Barnes
3,257,503 A 6/1966 Lentz et al.
5,839,403 A * 11/1998 Grant ..... H01T 13/08 123/169 R
5,979,387 A * 11/1999 Strait ..... H01T 13/08 123/169 PA
8,104,445 B2 1/2012 Seeger
9,322,630 B2 4/2016 Wilkins et al.
2009/0102345 A1* 4/2009 Hotta ..... H01T 13/36 313/120
2015/0176520 A1* 6/2015 Berger ..... H01T 13/16 123/169 EL

* cited by examiner

*Primary Examiner* — Christopher M Raabe
(74) *Attorney, Agent, or Firm* — Brooks Kushman P.C.; Geoffrey Brumbaugh

(57) ABSTRACT

A spark plug assembly is provided with an insulator body extending along a longitudinal axis and defining a first face extending radially and positioned between the first and second ends. A central electrode extends through the insulator body, and a side electrode is connected to the insulator body for rotation therewith. A retainer is connected to the second end of the insulator body and defines a second face extending radially. A jacket is rotatably supported by and surrounds the insulator body. The jacket is positioned between the first and second faces, and defines an inner surface and a threaded outer surface. A bushing is rotatably supported by and surrounds the insulator body, is positioned radially between the jacket and the insulator body, and is positioned between the first and second faces. The bushing defines a tapered outer surface to mate with the inner surface of the jacket.

20 Claims, 3 Drawing Sheets

SPARK PLUG ASSEMBLY FOR AN INTERNAL COMBUSTION ENGINE

TECHNICAL FIELD

Various embodiments relate to a spark plug assembly for an internal combustion engine.

BACKGROUND

Increases in engine and combustion efficiencies have been shown as a result of indexing, or radially orienting, a grounding strap of a spark plug within the engine. One example of a method to index a spark plug is by coordinating the starting of thread location and thread length of both the spark plug and mating spark plug hole. However, the machining and assembly processes required for such a method of indexing result in additional manufacturing complexities and costs in comparison to an unindexed spark plug.

SUMMARY

According to an embodiment, an engine is provided with a cylinder head having an intake valve port and a threaded spark plug port, and a spark plug assembly connected to the cylinder head. The spark plug assembly has an insulator body extending along a longitudinal axis from a first end to a second end, with the second end defining a tip. The insulator body defines a first face extending radially, with the first face positioned between the first and second ends. A central electrode extends through the insulator body from the first end to the second end. A side electrode is connected to the insulator body for rotation therewith. A terminal is supported by the first end of the insulator body and defines an alignment indicium indicative of a radial orientation of the side electrode. A retainer is connected to the second end of the insulator body, with the retainer defining a second face extending radially. A jacket is rotatably supported by and surrounds the insulator body, with the jacket positioned between the first and second faces. The jacket has a drive head adjacent to the first face, and defines an inner surface and a threaded outer surface. The threaded outer surface is received by and mates with the threaded spark plug port. A bushing is rotatably supported by and surrounds the insulator body, and is positioned between the first and second faces. The bushing is positioned radially between the jacket and the insulator body. The bushing defines a tapered outer surface to mate with the inner surface of the jacket. The first and second faces limit movement of the jacket and the bushing along the longitudinal axis such that the jacket and the bushing are captive. An inner surface of the bushing, the tapered outer surface of the bushing, and the inner surface of the jacket are unthreaded.

According to another embodiment, a spark plug assembly is provided with an insulator body extending along a longitudinal axis from a first end to a second end, with the second end defining a tip. The insulator body defines a first face extending radially, with the first face positioned between the first and second ends. A central electrode extends through the insulator body from the first end to the second end. A side electrode is connected to the insulator body for rotation therewith. A retainer is connected to the second end of the insulator body, with the retainer defining a second face extending radially. A jacket is rotatably supported by and surrounds the insulator body, with the jacket positioned between the first and second faces. The jacket defines an inner surface and a threaded outer surface. A bushing is rotatably supported by and surrounds the insulator body, with the bushing positioned radially between the jacket and the insulator body. The bushing is positioned between the first and second faces. The bushing defines a tapered outer surface to mate with the inner surface of the jacket.

According to yet another embodiment, a method of assembling an engine is provided. A cylinder head is provided with an intake valve port and a threaded spark plug port. A spark plug assembly is provided with an insulator body extending between a terminal and a retainer, and with the insulator body defining a first face extending radially, and the retainer defining a second face extending radially. The spark plug assembly is positioned into the threaded spark plug port. A side electrode is indexed to a selected radial position relative to the intake valve port by rotating the terminal, wherein the terminal, the insulator body, and the side electrode are connected to one another for rotation therewith. A jacket of the spark plug assembly is screwed into the threaded spark plug port while the side electrode is maintained in the selected radial position such that a threaded outer surface of the jacket mates with the threaded spark plug port. The jacket is supported for rotation on the insulator body between the first and second faces, with the first and second faces limiting translational movement of the jacket. Screwing the jacket into the threaded spark plug port causes an inner surface of the jacket to engage and deform an outer tapered surface of a bushing positioned radially between the jacket and the insulator body, thereby securing the jacket to the insulator body.

DETAILED DESCRIPTION

As required, detailed embodiments of the present disclosure are provided herein; however, it is to be understood that the disclosed embodiments are merely examples and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1:
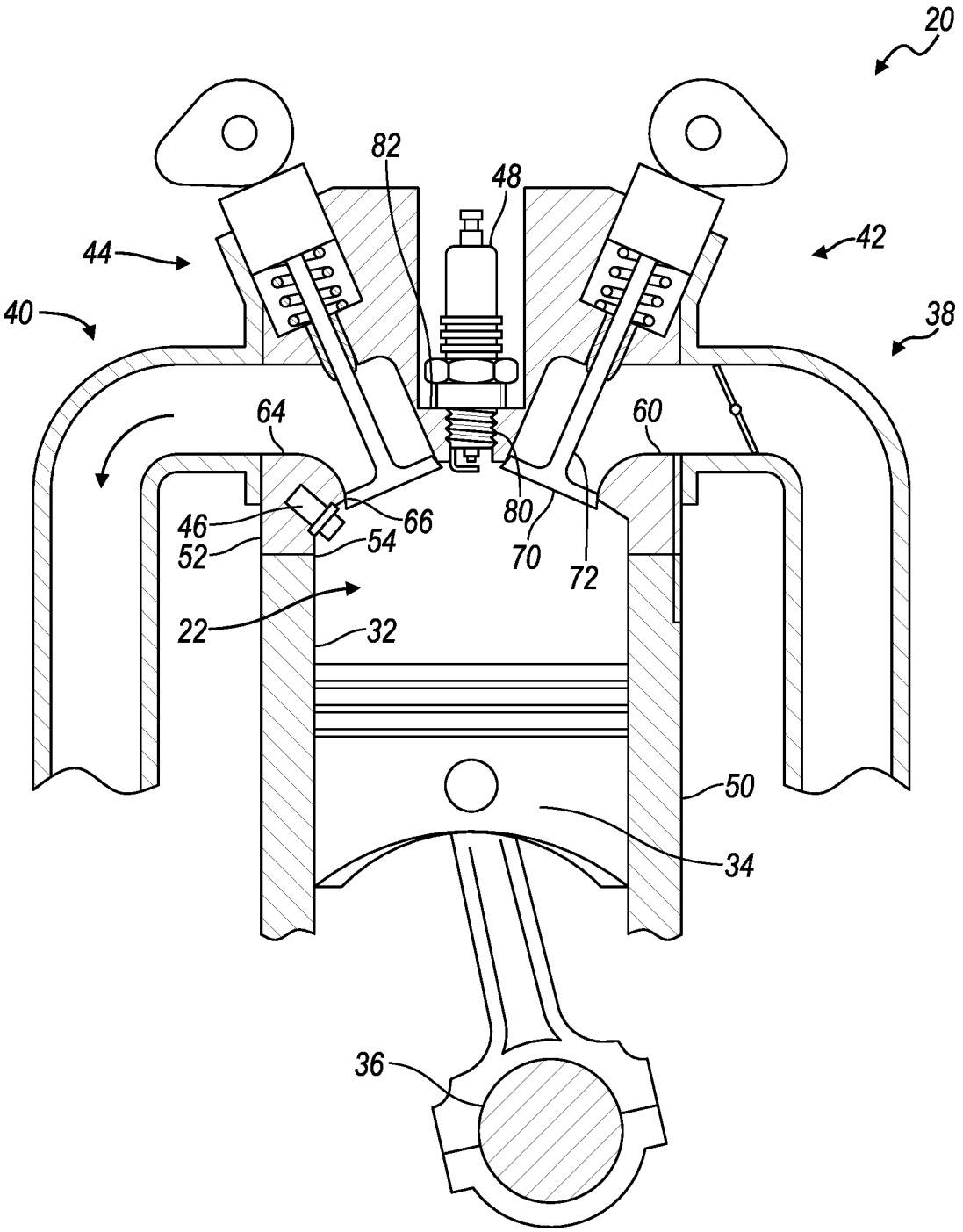
FIG. 1 illustrates a schematic of an internal combustion engine according to an embodiment.
Figure 2:
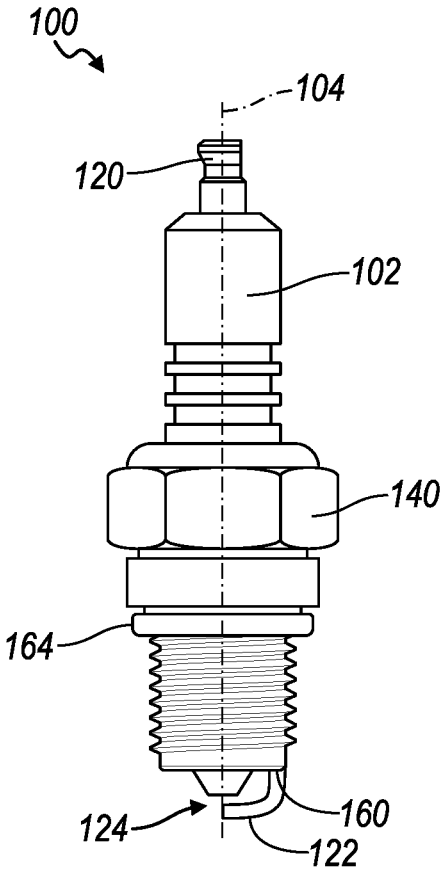
FIG. 2 illustrates side view of a spark plug assembly according to an embodiment.
Figure 3:
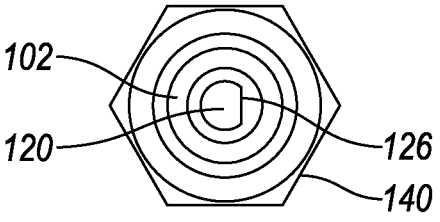
FIG. 3 illustrates a top view of the spark plug assembly of FIG. 2.
Figure 4:
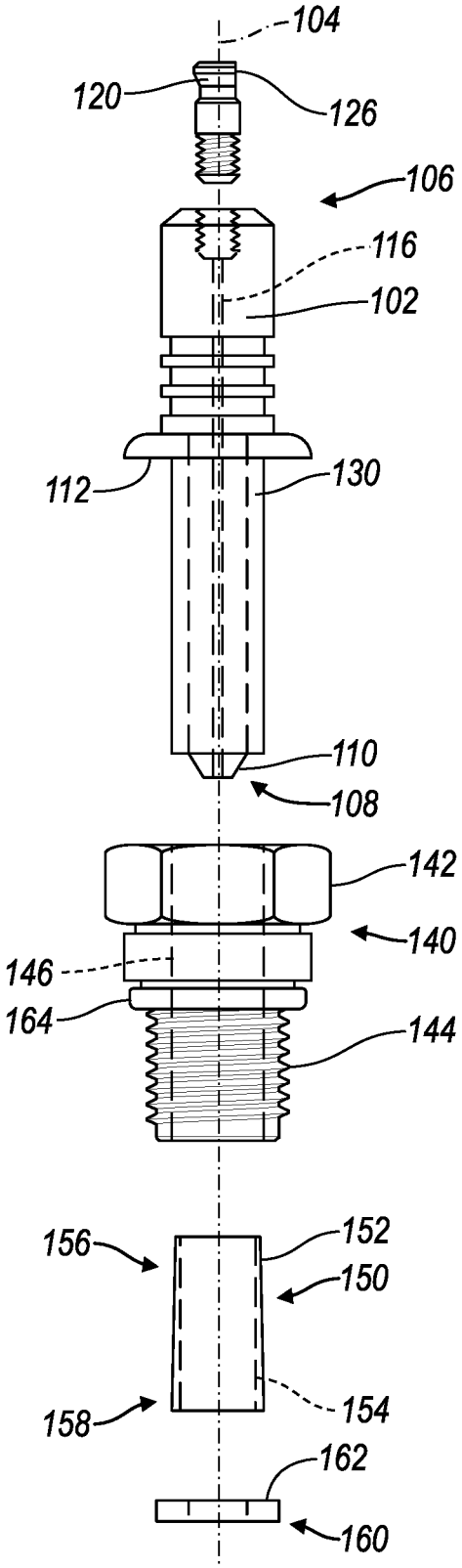
FIG. 4 illustrates a partial exploded view of the spark plug assembly of FIG. 2.
Figure 5:
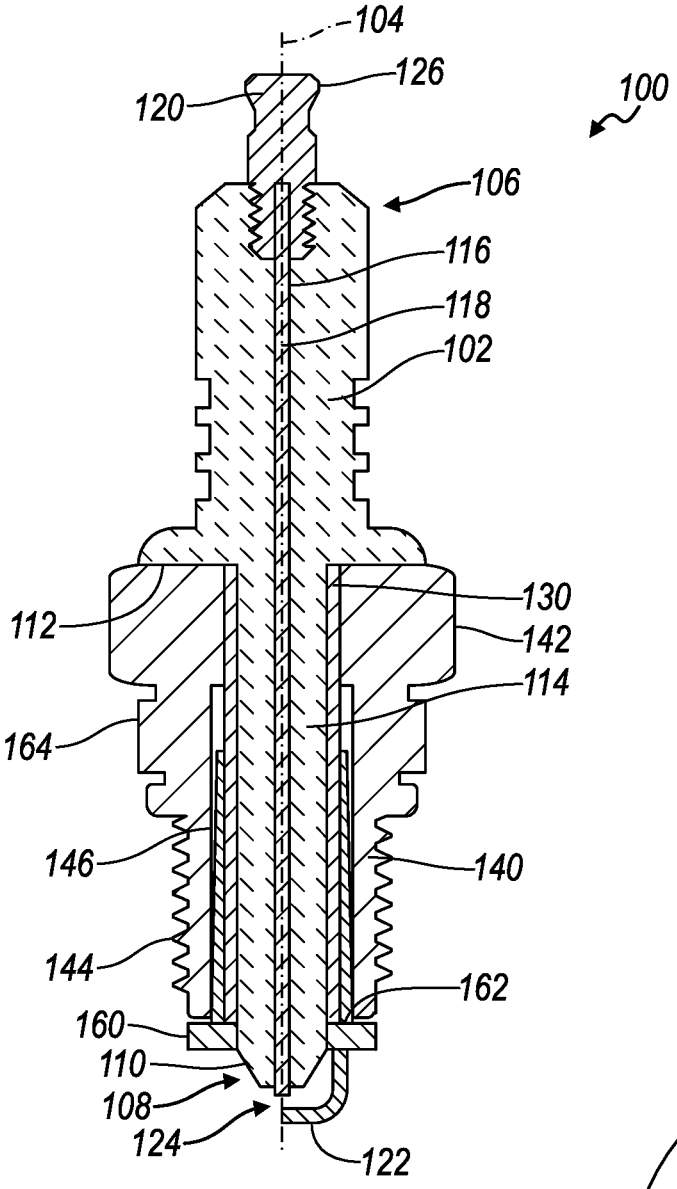
FIG. 5 illustrates a sectional schematic view of the spark plug assembly of FIG. 2.
Figure 6:
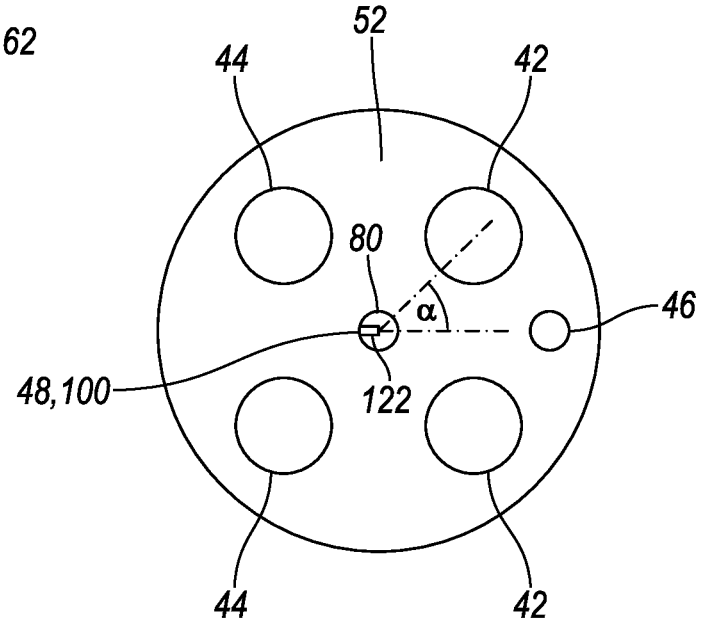
FIG. 6 illustrates a schematic of the spark plug assembly of FIG. 2 in a cylinder head.

FIG. 1 illustrates a schematic of an internal combustion engine 20. The engine 20 has a plurality of cylinders 22, and one cylinder is illustrated. The cylinder 22 is formed by cylinder walls 32 and piston 34, and is also referred to herein as a combustion chamber 22. The piston 34 is connected to a crankshaft 36. The combustion chamber 22 is in fluid communication with the intake manifold 38 and the exhaust manifold 40. One or more intake valves 42 controls flow from the intake manifold 38 into the combustion chamber. One or more exhaust valves 44 controls flow from the combustion chamber to the exhaust manifold 40. The intake and exhaust valves 42, 44 may be operated in various ways as is known in the art to control the engine operation. For example, each valve 42, 44 may be mechanically operated by a respective camshaft, or alternatively, may be hydraulically or electrically controlled.

A fuel injector 46 delivers fuel from a fuel system directly into the combustion chamber 22 such that the engine is a direct injection engine. A low pressure or high pressure fuel injection system may be used with the engine 20, or a port injection system may be used in other examples. An ignition system includes a spark plug 48 that is controlled to provide energy in the form of a spark to ignite a fuel air mixture in the combustion chamber. The spark plug 48 may be located in various positions within the combustion chamber 22. In other embodiments, other fuel delivery systems and ignition systems or techniques may be used, including indirect injection or compression ignition.

The engine 20 includes a controller and various sensors configured to provide signals to the controller for use in controlling the air and fuel delivery to the engine, the ignition timing, valve timing, the power and torque output from the engine, and the like. Engine sensors may include, but are not limited to, an oxygen sensor in the exhaust manifold 40, an engine coolant temperature, an accelerator pedal position sensor, an engine manifold pressure (MAP) sensor, an engine position sensor for crankshaft position, an air mass sensor in the intake manifold 38, a throttle position sensor, and the like.

In some embodiments, the engine 20 is used as the sole prime mover in a vehicle, such as a conventional vehicle, or a stop-start vehicle. In other embodiments, the engine may be used in a hybrid vehicle where an additional prime mover, such as an electric machine, is available to provide additional power to propel the vehicle.

Each cylinder 22 may operate under a four-stroke cycle including an intake stroke, a compression stroke, an ignition stroke, and an exhaust stroke. In other embodiments, the engine may operate with a two-stroke cycle. The piston 34 position at the top of the cylinder 22 is generally known as top dead center (TDC). The piston 34 position at the bottom of the cylinder is generally known as bottom dead center (BDC).

During the intake stroke, the intake valve(s) 42 opens and the exhaust valve(s) 44 closes while the piston 34 moves from the top of the cylinder 22 to the bottom of the cylinder 22 to introduce intake gases, e.g. air, from the intake manifold to the combustion chamber. Fuel may begin to be introduced at this time when the piston moves down during the intake stroke During the compression stroke, the intake and exhaust valves 42, 44 are closed. The piston 34 moves from the bottom towards the top of the cylinder 22 to compress the air/fuel mixture within the combustion chamber 22.

The compressed fuel/air mixture is then ignited within the combustion chamber 22. In the engine 20 shown, the fuel is injected into the chamber 22 and is then ignited using spark plug 48 according to the present disclosure and described further below with reference to FIGS. 2-6.

During the expansion stroke, the ignited fuel-air mixture in the combustion chamber 22 expands, thereby causing the piston 34 to move from the top of the cylinder 22 to the bottom of the cylinder 22. The movement of the piston 34 causes a corresponding movement in crankshaft 36 and provides for a mechanical torque output from the engine 20.

During the exhaust stroke, the intake valve(s) 42 remains closed, and the exhaust valve(s) 44 opens. The piston 34 moves from the bottom of the cylinder to the top of the cylinder 22 to remove the exhaust gases and combustion products from the combustion chamber 22 by reducing the volume of the chamber 22. The exhaust gases flow from the combustion cylinder 22 to the exhaust manifold 40 and to an aftertreatment system such as a catalytic converter.

The intake and exhaust valves 42, 44 positions and timing, as well as the fuel injection timing and ignition timing may be varied for the various engine strokes.

The engine 20 has an engine cylinder block 50 and a cylinder head 52. A head gasket 54 is interposed between the cylinder block 50 and the cylinder head 52 to seal the cylinders 22.

The cylinder head 52 defines an intake air port 60. The intake air port 60 provides a passage for flow of intake air or intake gases from the intake manifold 38 to a respective cylinder 22. Intake air may include outside or environmental air, may include fuel mixed therein, and may also be mixed with exhaust gases from an exhaust gas recirculation system, etc. The intake valve 42 seals the port 60 to prevent flow of intake air into the chamber 22 when the intake valve 42 is in a closed position, and is opened to allow flow of intake air into the chamber 22.

The cylinder head 52 defines an exhaust gas port 64. The exhaust gas port 64 provides a passage for flow of exhaust gases from each cylinder 22 to the exhaust manifold 40. The exhaust valve 44 seals the port 64 to prevent flow of exhaust gases into the port 64 when the exhaust valve 44 is in a closed position, and is opened to allow flow of exhaust gases out of the chamber 22 and into the port 64.

With reference to FIGS. 2-6, a spark plug assembly 100 is illustrated according to an embodiment. The spark plug assembly may be used as the spark plug 48 in engine 20.

The spark plug assembly 100 is connected to the cylinder head, such as cylinder head 52 in FIG. 1. Referring back to FIG. 1, the cylinder head 52 forms a spark plug port 80 that receives the spark plug assembly 48, 100. The spark plug port 80 may be threaded, for example, as a female threaded port. The port 80 extends through the cylinder head 52 such that the spark plug assembly 48, 100 can ignite a fuel air mixture within the engine, e.g. within the combustion chamber 22. An outer surface of the cylinder head forms a seat 82, and a seal may be formed between the spark plug assembly 48, 100 and the seat 82 to prevent gases from leaving the combustion chamber via the port 80.

With reference to FIGS. 2-6, the spark plug assembly 100 has an insulator body 102. The insulator body 102 extends along a longitudinal axis 104 from a first end 106 to a second end 108. The second end 108 of the insulator body 102 may form a tip 110 that extends into the combustion chamber and shields elements of the spark plug assembly 100 from the high temperature environment of the engine.

The insulator body 102 defines a first face 112 that is positioned between the first and second ends 106, 108 of the insulator body 102, and is spaced apart from the first and second ends 106, 108. The first face 112 extends radially or transversely on the insulator body 102, and may be provided by a flange or other surface. The first face 112 may extend about a perimeter of the insulator body 102 as shown, and may be a continuous surface. The first face 112 may extend radially outwardly from a lower cylindrical section 114 of the insulator body 102. The lower cylindrical section 114 extends from the first face 112 to the tip 110 at the second end 108 of the body.

The insulator body 102 is hollow and defines a passage 116 that extends along the longitudinal axis 104 and through the insulator body 102 from the first end 106 to the second end 108.

A central electrode 118 is provided with the spark plug assembly 100. The central electrode is positioned within the passage 116 of the insulator body 102, and extends through the insulator body 102 from the first end 106 to the second end 108. Although the central electrode 118 is illustrated as a single element for simplicity, it may include a resistor and one or more springs, as well as an electrode.

A terminal 120 is connected to the central electrode 118. The terminal 120 extends from the first end 106 of the insulator body 102, and is supported by the first end 106 of the insulator body. The terminal 120 is fixed for rotation with the insulator body 102, e.g. it is rigidly connected to the insulator body 102.

The spark plug assembly 100 also has a side ground electrode 122, or ground strap. The side ground electrode 122 is supported by the insulator body 102. The side ground electrode 122 is connected or fixed for rotation with the insulator body 102, e.g. if the insulator body 102 is moved or rotated, the side ground electrode 122 moves or rotates with the insulator body 102 and does not move relative to the insulator body 102. In other examples, electrode 118 may be the grounded electrode.

The spark plug assembly 100 may be provided with a single side ground electrode 122 as shown. In other examples, the spark plug assembly 100 may have more than one side ground electrode 122.

An electrode gap 124 is formed between the side ground electrode 122 and the end of the central electrode 118. In use, the side ground electrode 122 is electrically grounded by the cylinder head 52, while central electrode 118 is electrically isolated from the side ground electrode 122 via the insulator body 102. The gap 124 is formed between the end of the central electrode 118 and the side ground electrode 122. When the central electrode 118 is supplied with sufficient voltage and current, an electrical current crosses or bridges the gap 124 between the central electrode 118 and the side ground electrode 122, e.g. via a plasma, thereby sparking or igniting an air/fuel mixture within the combustion chamber.

The orientation of the side ground electrode 122, or the positioning of the electrode gap 124 within the combustion chamber locates the side ground electrode 122 such that it reduces any shielding of the spark from the fuel/air charge and does not impede a flame front as it travels away from the spark plug assembly 100 into the chamber. In one example, the spark plug assembly 100 may be indexed such that the electrode gap 124 faces towards the valves, faces or is aimed at a central region of the combustion chamber, or is otherwise oriented.

The spark plug assembly 100 according to the present disclosure provides for indexing or positioning the side ground electrode 122 and associated electrode gap 124 relative to the intake port(s), the exhaust port(s), and/or a central region of the combustion chamber during installation of the spark plug assembly 100 into the cylinder head 52. The present disclosure further provides a spark plug assembly 100 with a straightforward installation process as described below, and without advanced or complicated manufacturing techniques.

The spark plug assembly 100 is provided with an orientation mark 126, indicium, or indicia that are indicative of the orientation or location of the side ground electrode 122 and the associated electrode gap 124. In one example, the indicia 126 may be formed or provided on the terminal 120. The indicia or alignment indicia 126 may indicative of a radial orientation of the side ground electrode 122 and associated electrode gap 124 relative to the cylinder head and combustion chamber. The indicia 126 may be provided by an alignment face on the terminal 120 according to a further example. In other examples, the indicia may be provided by another shape on the terminal 120.

A sleeve 130 is connected to the lower section 114 of the insulator body 102. The sleeve 130 is fixed to the insulator body 102 such that it rotates with the insulator body 102. The sleeve 130 extends from adjacent to the first face 112 towards the second end 108 of the insulator body 102.

A jacket 140 is rotatably supported by and surrounds the insulator body 102 and the sleeve 130. The jacket 140 forms a drive head 142, and the drive head 142 is positioned adjacent to the first face 112. The drive head 142 cooperates with the first face 112 to limit movement of the jacket 140 along the longitudinal axis 104. The drive head 142 may be provided by a hexagonal bolt head, or the like. The jacket 140 extend from the drive head 142 at one end to a threaded outer surface 144 at the other end. The threaded outer surface 144 is received by and mates with the threaded spark plug port 80 in the cylinder head. The jacket 140 has an inner surface 146. The inner surface 146 may be cylindrical according to the example shown, or may have a tapered shape. The tapered shape of the inner surface 146 may be frusto-conical, stepped, or another non-linear taper. The inner surface 146 of the jacket 140 is unthreaded.

A bushing 150 is rotatably supported by and surrounds the insulator body 102 and the sleeve 130. The bushing 150 is positioned at least partially radially between the sleeve 130 and the jacket 140, and the sleeve 130 is therefore positioned between the bushing 150 and the insulator body 102. The jacket 140 therefore receives at least a portion of the bushing 150, e.g. the bushing nests within the jacket 140

The bushing 150 defines a tapered outer surface 152 that mates or cooperates with the inner surface 146 of the jacket 140. The tapered outer surface 152 of the bushing 150 may be frusto-conical, stepped, or another non-linear tapered shape. The inner surface 154 of the bushing 150 is sized to receive the sleeve 130, and may be cylindrical in shape. The inner and outer surfaces 154, 152 of the bushing 150 are both unthreaded.

The bushing 150 has a first end 156 with a first outer diameter and a second end 158 with a second outer diameter greater than the first diameter. The first end 156 of the bushing 150 is positioned between the first face 112 and the second end 158 of the bushing such that at least the first end 156 of the bushing is received within the jacket 140. The first outer diameter of the bushing 150 is therefore less than a diameter of the inner wall 146 of the jacket 140.

A retainer 160 is connected to the second end 108 of the insulator body 102, and may be connected to or formed by the sleeve 130. The retainer 160 defines a second face 162 extending radially or transversely. In one example, the retainer 160 is provided as a circlip or other fastener on an end of the sleeve 130. In another example, the retainer 160 may be formed from a lip or other portion of the sleeve 130 that is formed to extend radially after the jacket 140 and bushing are positioned on the sleeve 130, such as a rolled flange.

The side ground electrode 122 may be directly and electrically connected to one of the sleeve 130 and the retainer 160. In one example, the side ground electrode 122 is directly connected to the sleeve 130 such that it is affixed to and rotates with the sleeve 130. In another example, the side ground electrode 122 is directly connected to the retainer 160 such that it is affixed to and rotates with the retainer 160, with the retainer being rigidly connected to and rotating with the sleeve 130 and the terminal. The sleeve 130, the jacket 140, the bushing 150, and the retainer 160 may each comprise metal. The insulator body 102 may be formed from a ceramic or another electrically non-conductive material.

The jacket 140 is therefore positioned between the first and second faces 112, 162 of the assembly, and the bushing 150 is also positioned between the first and second faces 112, 162. The first and second faces 112, 162 act to limit movement of the jacket 140 and the bushing 150 along the longitudinal axis 104 such that the jacket 140 and the bushing 150 are captive on the assembly. Prior to inserting the spark plug assembly 100 into the cylinder head, the jacket 140 and the bushing 150 both rotate freely on the sleeve 130 and insulator body 102 about the longitudinal axis 104, and also rotate freely relative to one another.

One or more sealing members 164 may be provided on the spark plug assembly 100. In one example, and as shown, a washer 164 is supported by and surrounds the jacket 140, and is positioned between the drive head 142 and the threaded outer surface 144. The washer 164 interfaces with an outer surface or seat 82 of the cylinder head 52 to aid in sealing the threaded spark plug port 80. The assembly 100 may have additional sealing members, such as internal sealing members that are not illustrated for simplicity.

According to an example, an engine 20 may be assembled by providing a cylinder head 52 with an intake valve port 60 and a threaded spark plug port 80. A spark plug assembly 100 is also provided with an insulator body 102 extending between a terminal 120 and a retainer 160. The insulator body 102 defines a first face 112 extending radially, and the retainer 160 defines a second face 162 extending radially.

The spark plug assembly 100 may be provided by first sliding the jacket 140 onto a cylindrical sleeve 130 connected to the insulator body 102 such that a drive head 142 of the jacket 140 is directly adjacent to the first face 112, then sliding the bushing 150 onto the cylindrical sleeve 130 such that at least a portion of the bushing 150 is received within the jacket 140, and finally establishing the retainer 160 such that the jacket 140 and the bushing 150 are captive on the insulator body 102. The bushing 150 and the jacket 140 therefore each independently and freely rotate relative to the insulator body 102 prior to screwing the jacket 140 into the threaded spark plug port.

The spark plug assembly 100 is positioned into the threaded spark plug port 80. The side ground electrode 122 is indexed or positioned to a selected radial position relative to an element of the cylinder head 52. In the example shown in FIG. 6, the spark plug assembly 100 is indexed relative to an intake valve port 60 or intake valve 42 by an angle α by rotating the terminal 120. In other examples, another reference point or element in the engine 20 or cylinder head 52 may be used to index the spark plug assembly 100. The indicia or alignment face 126 of the terminal 120 may be used to locate the side ground electrode 122 in the selected radial position. The terminal 120, the insulator body 102, and the side ground electrode 122 are connected to one another for rotation therewith, such that rotation of the terminal 120 causes a corresponding rotation of the side ground electrode 122.

A jacket 140 of the spark plug assembly 100 is screwed into the threaded spark plug port 80 while the side ground electrode 122 is maintained in the selected radial position such that a threaded outer surface 144 of the jacket 140 mates with the threaded spark plug port 80. The jacket 140 is supported for rotation on the insulator body 102 between the first and second faces 112, 162, with the first and second faces 112, 162 limiting translational movement of the jacket 140.

The position of the terminal 120 and side ground electrode 122 may be maintained by placing a tool on the terminal 120 while the jacket 140 is being screwed into the cylinder head. The tool may have a shape or aperture formed and sized to engage with the terminal 120, e.g. with the alignment face 126, to prevent rotation of the terminal 120, insulator body 102, and side ground electrode 122 about the longitudinal axis 104, thereby maintaining its location or selected angle α.

Screwing the jacket 140 into the threaded spark plug port 80 causes an inner surface 146 of the jacket 140 to engage and deform an outer tapered surface 152 of a bushing 150 positioned radially between the jacket 140 and the insulator body 102, thereby securing the jacket 140 to the insulator body 102. The interface between the bushing 150 and the jacket 140 also forms another sealing interface for the spark plug assembly 100, as the jacket 140 mechanically deforms or crimps the jacket 140 at the interface between the two components 140, 150. The mechanical deformation between the two components 14, 150 may be sufficient to cause them to bind to one another. In one example, the mechanical deformation is a plastic deformation in the jacket 140 and/or the bushing 150. The second face 162 of the spark plug assembly 100 exerts a force onto the bushing 150 along the longitudinal axis 104 of the spark plug assembly 100 in response to the jacket 140 being screwed into the threaded spark plug port thereby causing the bushing 150 to engage with the jacket 140. As the jacket 140 is screwed or rotated into the cylinder head, the jacket 140 therefore comes into hard contact with the bushing 150, and the jacket 140 therefore secures the spark plug assembly 100 in the head with the side ground electrode 122 held and secured in the selected radial position at angle α.

In order to replace a spark plug assembly 100, or to adjust a radial position of the electrode gap 124, the spark plug assembly 100 may be removed from the spark plug port 80. Unscrewing the jacket 140 from the threaded spark plug port 80 causes the jacket 140 to exert a force along the longitudinal axis 104 of the spark plug assembly 100 onto the first face 112, thereby causing the entire spark plug assembly 100 to move axially or translate along the longitudinal axis 104 away from and out of the threaded spark plug port 80.

As such, various embodiments according to the present disclosure have associated, non-limiting advantages. For example, the threads on the cylinder head spark plug port and spark plug do not need to be machined in a specific manner, e.g. with a thread start location and number of threads predetermined, to determine the alignment of the electrode gap 124. Additionally, it is easier to install the spark plug assembly 100 according to the present disclosure into a desired radial orientation or index the assembly 100 to the desired location or angle α. By incorporating a terminal 120 with an alignment face or other indicia that is secured and fixed relative to an insulator body 102 with a first face 112, the position of the side grounding electrode 122 may be known when the spark plug assembly 100 is installed in an engine, such as engine 20. By having a jacket 140 that is captive and freely rotates on insulator body 102, the spark plug assembly 100 may be installed with the side ground electrode 122 in a known location and held there while the jacket 140 is screwed into the cylinder head 52. The first face 112 and the second face 162 on the spark plug assembly 100 retain the jacket 140 and bushing 150 on the assembly. The second, lower face 162 interfaces with and imparts a force on the bushing 150, which in turn secures the jacket 140 to the insulator body 102 during installation and with clockwise rotation of the jacket 140. When removing or extracting the spark plug assembly 100, the counterclockwise rotation of the jacket 140 imparts a force from the jacket 140 onto the upper face 112, cause a reactionary force on the first face 112, which in turn moves the entire spark plug assembly 100 axially out of the spark plug port. The jacket 140 and bushing 150 both freely rotate about the sleeve 130 and about the axis 104 of the insulator until the jacket 140 is fastened or screwed into the cylinder head 52, and the terminal 120 and side ground electrode 122 may be maintained in a selected radial position, or at an angle $\alpha$ via use of a tool that receives and interfaces with the terminal 120.

While exemplary embodiments are described above, it is not intended that these embodiments describe all possible forms of the disclosure. Rather, the words used in the specification are words of description rather than limitation, and it is understood that various changes may be made without departing from the spirit and scope of the disclosure and/or invention. Additionally, the features of various implementing embodiments may be combined to form further embodiments of the disclosure and/or invention.

What is claimed is:

1. An engine comprising:

a cylinder head having an intake valve port and a threaded spark plug port; and a spark plug assembly connected to the cylinder head, the spark plug assembly with:

an insulator body extending along a longitudinal axis from a first end to a second end, the second end defining a tip, the insulator body defining a first face extending radially, the first face positioned between the first and second ends, a central electrode extending through the insulator body from the first end to the second end, a side electrode connected to the insulator body for rotation therewith, a terminal supported by the first end of the insulator body and defining alignment indicium indicative of a radial orientation of the side electrode, a retainer connected to the second end of the insulator body, the retainer defining a second face extending radially, a jacket rotatably supported by and surrounding the insulator body, the jacket positioned between the first and second faces, the jacket having a drive head adjacent to the first face, and defining an inner surface and a threaded outer surface, the threaded outer surface received by and mating with the threaded spark plug port, and a bushing rotatably supported by and surrounding the insulator body and positioned between the first and second faces, the bushing positioned radially between the jacket and the insulator body, the bushing defining a tapered outer surface to mate with the inner surface of the jacket, wherein the first and second faces limit movement of the jacket and the bushing along the longitudinal axis such that the jacket and the bushing are captive, and wherein an inner surface of the bushing, the tapered outer surface of the bushing, and the inner surface of the jacket are unthreaded.

2. The engine of claim 1 wherein an electrode gap of the spark plug assembly is positioned at a predetermined radial position relative to the intake valve port.

3. The spark plug assembly of claim 1 wherein the spark plug assembly further comprises a sleeve connected to the insulator body for rotation therewith, the sleeve extending from adjacent to the first face towards the second end of the insulator body;

wherein the bushing is rotatably supported by and surrounds the sleeve such that the sleeve is positioned between the bushing and the insulator body; and wherein the side electrode is directly connected to one of the sleeve and the retainer.

4. A spark plug assembly comprising:

an insulator body extending along a longitudinal axis from a first end to a second end, the second end defining a tip, the insulator body defining a first face extending radially, the first face positioned between the first and second ends;

a central electrode extending through the insulator body from the first end to the second end;

a side electrode connected to the insulator body for rotation therewith;

a retainer connected to the second end of the insulator body, the retainer defining a second face extending radially;

a jacket rotatably supported by and surrounding the insulator body, the jacket positioned between the first and second faces, the jacket defining an inner surface and a threaded outer surface; and a bushing rotatably supported by and surrounding the insulator body, the bushing positioned radially between the jacket and the insulator body, the bushing positioned between the first and second faces, the bushing defining a tapered outer surface to mate with the inner surface of the jacket.

5. The spark plug assembly of claim 4 wherein the first and second faces limit movement of the jacket and the bushing along the longitudinal axis such that the jacket and the bushing are captive.

6. The spark plug assembly of claim 4 wherein the tapered bushing has a first end with a first diameter and a second end with a second diameter greater than the first diameter, wherein the second end of the bushing is positioned between the first end of the bushing and the retainer such that at least the first end of the bushing is received within the jacket.

7. The spark plug assembly of claim 4 wherein the jacket forms a drive head positioned adjacent to the first face, the drive head cooperating with the first face to limit movement of the jacket along the longitudinal axis.

8. The spark plug assembly of claim 7 further comprising a washer supported by and surrounding the jacket, and positioned between the drive head and the threaded outer surface.

9. The spark plug assembly of claim 4 wherein the inner surface of the jacket is cylindrical.

10. The spark plug assembly of claim 4 wherein an inner surface of the bushing, the tapered outer surface of the bushing, and the inner surface of the jacket are unthreaded.

11. The spark plug assembly of claim 4 further comprising a sleeve connected to the insulator body for rotation therewith, the sleeve extending from adjacent to the first face towards the second end of the insulator body;

wherein the bushing is rotatably supported by and surrounds the sleeve such that the sleeve is positioned between the bushing and the insulator body.

12. The spark plug assembly of claim 11 wherein the side electrode is directly connected to one of the sleeve and the retainer.

13. The spark plug assembly of claim 11 wherein the sleeve, the jacket, the bushing, and the retainer each comprise metal.

14. The spark plug assembly of claim 4 further comprising a terminal extending from the first end of the insulator body, the terminal having indicia indicative of the orientation of the side electrode and an associated electrode gap.

15. The spark plug assembly of claim 14 wherein the indicia is an alignment face.

16. The spark plug assembly of claim 4 wherein the retainer is a circlip.

17. A method of assembling an engine, the method comprising:

providing a cylinder head with an intake valve port and a threaded spark plug port;

providing a spark plug assembly with an insulator body extending between a terminal and a retainer, the insulator body defining a first face extending radially, the retainer defining a second face extending radially, positioning the spark plug assembly into the threaded spark plug port;

indexing a side electrode to a selected radial position relative to the intake valve port by rotating the terminal, wherein the terminal, the insulator body, and the side electrode are connected to one another for rotation therewith; and screwing a jacket of the spark plug assembly into the threaded spark plug port while maintaining the side electrode in the selected radial position such that a threaded outer surface of the jacket mates with the threaded spark plug port, wherein the jacket is supported for rotation on the insulator body between the first and second faces, with the first and second faces limiting translational movement of the jacket;

wherein screwing the jacket into the threaded spark plug port causes an inner surface of the jacket to engage and deform an outer tapered surface of a bushing positioned radially between the jacket and the insulator body, thereby securing the jacket to the insulator body.

18. The method of claim 17 wherein providing the spark plug assembly further comprises sliding the jacket onto a cylindrical sleeve connected to the insulator body such that a drive head of the jacket is directly adjacent to the first face, sliding the bushing onto the cylindrical sleeve such that at least a portion of the bushing is received within the jacket, and establishing the retainer such that the jacket and the bushing are captive on the insulator body, wherein the bushing and the jacket freely rotate relative to the insulator body prior to screwing the jacket into the threaded spark plug port.

19. The method of claim 17 wherein the second face exerts a force onto the bushing along a longitudinal axis of the spark plug assembly in response to the jacket of the spark plug assembly being screwed into the threaded spark plug port thereby causing the bushing to engage with the jacket.

20. The method of claim 17 further comprising unscrewing the jacket from the threaded spark plug port such that the jacket exerts a force along a longitudinal axis of the spark plug assembly onto the first face, thereby causing the spark plug assembly to translate along the longitudinal axis away from the threaded spark plug port.

* * * * *